United States Patent [19]

Hara

[11] 4,281,307

[45] Jul. 28, 1981

[54] THERMAL CUT-OFF FUSE

[75] Inventor: Kunio Hara, Kawasaki, Japan

[73] Assignee: Nifco Inc., Kanagawa, Japan

[21] Appl. No.: 123,133

[22] Filed: Feb. 21, 1980

[51] Int. Cl.[3] ..... H01H 37/36

[52] U.S. Cl. ..... 337/114; 337/118; 337/122; 337/407

[58] Field of Search ..... 337/114, 118, 122, 407, 337/408, 409

[56] References Cited

U.S. PATENT DOCUMENTS

| | | | |
|---|---|---|---|
| 2,955,179 | 10/1960 | Milton et al. | 337/408 X |
| 3,909,763 | 9/1975 | Soeno et al. | 337/114 X |
| 3,956,725 | 5/1976 | Merrill et al. | 337/407 |
| 4,024,488 | 5/1977 | Kamino | 337/114 |
| 4,186,366 | 1/1980 | McVey | 337/407 |

*Primary Examiner*—George Harris

*Attorney, Agent, or Firm*—Glenn W. Bowen; Thomas W. Buckman

[57] ABSTRACT

A thermal cut-off fuse of a self-restoring type, which breaks the electric continuity between a pair of lead wires in response to melting and voluminal expansion of a temperature-sensitive member upon rise of the ambient temperature to a prescribed temperature and, in response to restoration of spring means upon fall of the ambient temperature below the prescribed temperature, reestablishes the electric continuity between the pair of lead wires.

5 Claims, 9 Drawing Figures

THERMAL CUT-OFF FUSE

BACKGROUND OF THE INVENTION

This invention relates to a thermal cut-off fuse. More particularly, this invention relates to a self-restoring type thermal cut-off fuse which, on rise of the temperature of the ambience to a prescribed temperature, breaks the electric continuity between a pair of electric lead wires extended out of a housing in response to melting of a temperature-sensitive member contained in the housing and, on fall of the temperature of the ambience below the preset temperature, reestablishes the electric continuity between the aforementioned pair of lead wires.

Thermal cut-off fuses of the type which use the melting points of a temperature-sensitive member as their rated (prescribed) temperatures and only serve to break the electric continuity between paired lead wires at these preset temperatures are used with good results in various electric appliances susceptible to accidental overheating. A fair number of types of such thermal cut-off fuses have so far been disclosed to the art. (U.S. Pat. Nos. 4,068,204, 4,075,595, 4,075,596, 4,084,147, 4,127,839, for example.)

The thermal cut-off fuses of this class are so constructed that once the electric continuity is broken, they cannot restore the original electric continuity and have had to be discarded.

The purpose of such thermal cut-off fuses is to ensure the safe operation of electric appliances. When troubles of some form or other develop in the fused electric appliance and overheating causes the temperatures to rise beyond the prescribed temperature, the fuse melts and breaks the electric circuit. If the fuse thus broken is accidentally reset after the ambient temperature of the fuse has fallen in consequence of the cut-off of the electric appliance, then the appliance will be exposed again to the same danger (overheating) unless the causes of the trouble have been detected and eliminated. In this sense, therefore, it is only natural that such fuses are not able to restore the electric continuity once it has been broken. However, none of the thermal cut-off fuses of the conventional types can take the place of thermostats which have heretofore been used in various kinds of conventional heating devices.

A self-restoring type thermal cut-off fuse using a temperature-sensitive member capable of taking the place of the conventional thermostat would prove highly useful.

In the first place, the thermal cut-off fuse of this type generally permits a substantial reduction in size, improves the space factor of the portion thereof enclosing the heat-sensitive circuit and, moreover, dispenses with the otherwise inevitable use of a massive, expensive metal part such as a bimetal strip and, therefore, proves to be economical. Above all, the fact that the temperature-sensitive member excels in temperature properties contributes immensely to the reliability of the circuit.

One object of this invention is to provide a self-restoring type thermal cut-off fuse which breaks the electric continuity of lead wires on rise of the temperature of the ambience thereof to the prescribed temperature and, after the aforementioned temperature has fallen below the preset temperature, reestablishes the electric continuity.

SUMMARY OF THE INVENTION

To accomplish the object described above according to the present invention, there is provided a thermal cut-off fuse which maintains electric continuity between first and second lead wires extended out of a housing at temperatures not higher than a prescribed temperature and, on rise of the temperature of the ambience thereof to the prescribed temperature, breaks the electric continuity, which thermal cut-off fuse comprises a housing, a contact means adapted to move between first and second positions within the hollow space of the housing and, while at the first position, electrically connect the first and second lead wires and, while at the second position, electrically isolate at least one of the first and second lead wires, a temperature-sensitive member sealed in the housing on the side of the aforementioned first position of the contact means, and energizing means adapted to keep the aforementioned contact means energized at all times toward the first position.

In the thermal cut-off fuse of such construction, when the temperature of the ambience is elevated by some cause or other to reach the melting point of the temperature-sensitive member, the temperature-sensitive member melts and voluminally expands so that the force of the voluminal expansion causes the contact means to be moved to the second position overcoming the force exerted by the energizing means. Consequently, the electric continuity between the first and second lead wires is broken. As the temperature of the ambience falls, the temperature-sensitive member begins to solidify with gradual loss of volume and, in turn, the energizing means pushes the contact means gradually in the direction of the first position. When the temperature-sensitive member has completely solidified, the contact means again establishes the electric continuity between the first and second lead wires. As described above, the thermal cut-off fuse of the present invention, without requiring any external assistance, breaks the electric continuity when the temperature of the ambience reaches the preset temperature and reestablishes the electric continuity when the temperature falls below the preset temperature.

The other objects and characteristics of the present invention will become apparent from the further disclosure of the invention to be made hereinafter with reference to the accompanying drawing.

Figure 1:
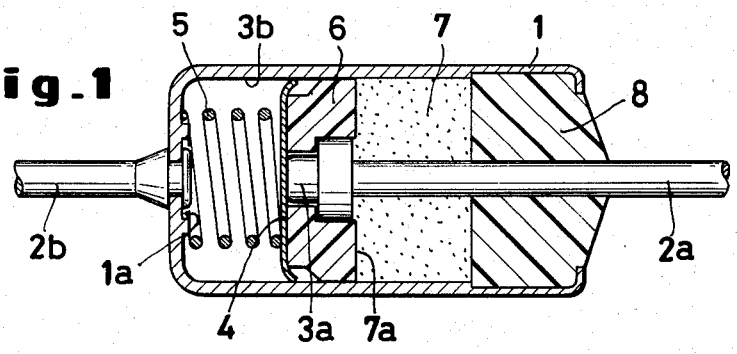
FIG. 1 is a longitudinally sectioned view of the first preferred embodiment of the thermal cut-off fuse according to the present invention, held in the normal state.
Figure 3:
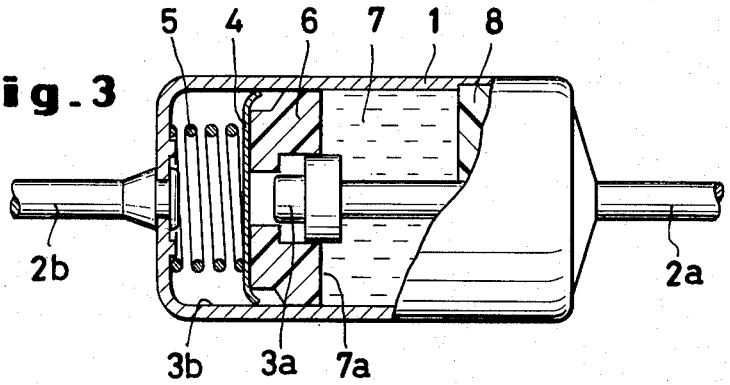
FIg. 3 is a longitudinally sectioned view of the thermal cut-off fuse of FIG. 1, in the state assumed after the temperature of the ambience has reached the prescribed temperature of the fuse.
Figure 2:
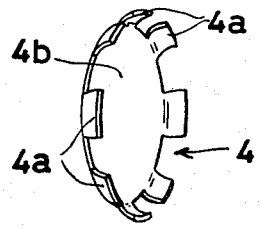
FIG. 2(A) is a perspective view of the contact means used in the first embodiment above.
FIG. 2(B) is a side view of the contact means of FIG. 2(A).
Figure 2:
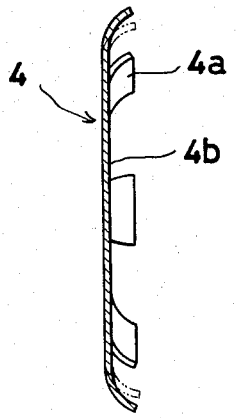

The thermal cut-off fuse of this invention illustrated in FIGS. 1–3 is of a tubular type, horizontal type or axial type having a pair of lead wires 2*a*, 2*b* extending in the opposite directions from a housing 1. Through an opening at one axial end of the housing 1, the first lead wire 2*a* penetrates into the hollow space of the housing. The leading end 3*a* of this lead wire forms the first terminal portion electrically connected to the first lead wire.

By contrast, the second lead wire 3*b* is attached caulkingly to the other axial end of the housing made of a suitable electrically conductive metal material. The inner wall 3*b* of the housing, therefore, serves as the second terminal portion for the second lead wire 2*b*.

Within the housing, there is provided contact means 4 which is adapted to remain in contact with both the terminals 3*a*, 3*b* and consequently establish electric continuity between the first and second lead wires 2*a*, 2*b* while the thermal cut-off fuse is in the normal state, namely when the temperature of the ambience is below the melting point of the temperature-sensitive member.

Since, in this case, the housing is assumed to possess a cylindrical shape as illustrated in FIG. 2(A), (B), the contact means 4 is formed substantially in the shape of a disc and is provided on the periphery thereof with a plurality of circumferentially spaced petal-like pieces 4*a* each slanted outwardly in the radial direction. The contact means is inserted into the hollow space of the housing with the petal-like pieces slightly bent inwardly and kept outwardly resilient. The resilient force adds to the fastness with which the electric contact is maintained between the contact means 4 and the inner wall 3*b* of the housing.

The contact means 4 is set in position in such a manner during the assemblage of the thermal cut-off fuse that the central portion 4*b* of the disc comes into contact with the end surface of the terminal portion 3*a* of the lead wire inserted into the housing as illustrated in FIG. 1. This is the first position for the contact means 4. To ensure perfect contact between the contact means 4 and the terminal portion 3*a*, spring means 5 capable of manifesting the resiliency as described afterward is disposed in a compressed state between the rear surface of the contact means and the surface 1*a* of the housing opposed to the aforementioned rear surface. The spring means 5, even in this state, exerts some energizing force in the direction of pressing the contact means 4 against the terminal portion 3*a*.

On the opposite surface of the contact means 4 is disposed a resilient bushing 6 made of rubber or resin and, therefore, able to produce a sealing action in cooperation with the inner wall of the housing and to slide on the inner wall of the housing. Behind the bushing 6 is sealed in a temperature-sensitive member 7 which normally assumes a solid state and melts at temperatures above the prescribed temperature. The rear end of the housing is tightly closed with a suitable seal means 8 made of resin, for example.

The temperature-sensitive member 7, therefore, is held inside the space on the side of the first position with reference to the contact means as the boundary. The surface of the temperature-sensitive member 7 opposed to the contact means 4, though sealed tightly, is allowed by the function described afterward to move in the direction of pushing the bushing 6. The other surfaces of the temperature-sensitive member are enclosed with the stationary wall surfaces.

The temperature-sensitive members used for the existing thermal cut-off fuses may be used in the present invention. In this case, since the member is generally formed as a pellet, the assemblage of the fuse can advantageously be effected if the member is subjected in advance to compression molding or melt molding to match the shape of the chamber for accommodating the member therein.

This invention is characterized, in one aspect, by directly utilizing a special property possessed generally by all temperature-sensitive members available for thermal cut-off fuses. This "property" is the melting and consequent expansion in volume of the temperature-sensitive member on reaching the prescribed temperature. This property is common to all temperature-sensitive members though to a varying extent depending on the kind of member. Generally, these members are of resin and can be expected to show coefficients of voluminal expansion within the range of from 3 to 8%, approximately.

Now, the function of the temperature-sensitive member in the present embodiment will be described below.

While the thermal cut-off fuse remains in the condition in which the temperature of the ambience is below the melting point of the temperature-sensitive member, the contact means 4 is kept at the first position and, by virtue of the energizing force exerted by the spring means 5, is held in contact with the first and second terminal portions 3*a*, 3*b* and consequently allowed to establish electric continuity between the two lead wires 2*a*, 2*b*.

When the temperature of the ambience is elevated by some cause or other to reach the prescribed temperature, however, the temperature-sensitive member melts with voluminal expansion. The force of this voluminal expansion overcomes the energizing force of the spring means 5 and pushes the contact means 4 to the left with reference to the drawing, through the medium of the bushing 6. Owing to this phenomenon, the contact means 4 separates from the terminal portion 3*a* of the lead wire inserted into the housing, with the result that the electric continuity between the two lead wires 2*a*, 2*b* is broken.

The condition resulting from the breakage of the electric continuity is shown in FIG. 3. Two requirements requiring special attention here are the requirement that even after the contact means 4 has been moved to the second position in consequence of the breakage of the electric continuity, the pellet in its molten state is tightly sealed lest it should leak from the space on the side of the first position past the contact means and the requirement that the spring means 5 acting upon the contact means is fully charged by compression.

The first requirement is met by forming the outer edge of the flange 2c supporting the terminal portion 3a of the lead wire 2a and the inner edge of the opening 6' of the bushing 6 in sizes permitting the two edges to form a perfect seal. The second requirement is easily satisfied by using spring means 5 possessed of a suitable energizing force.

As the temperature of the ambience falls, the temperature-sensitive member 7 is gradually solidified with proportional loss of volume. The spring means 5, therefore, pushes the contact means and the bushing back in the direction of the first position in proportion to the loss of volume of the temperature-sensitive member.

By the time the temperature of the ambience has sufficiently fallen and the temperature-sensitive member has solidified throughout, the contact means 4 again comes into contact with the terminal portion 3a as illustrated in FIG. 1, with the result that there is re-established the electric continuity between the two lead wires.

The alternate breaking and making of the electric continuity between the lead wires are repeated each time the temperature of the ambience rises to the prescribed temperature and falls from it.

The thermal cut-off fuse, therefore, can be used for the same purpose as the conventional thermostat and enjoys the advantage that the number of component parts is small and the reliability of the operation is high. This invention can provide a minute thermal cut-off fuse approximately 9 mm in length and 4 mm in diameter, for example.

Figure 4:
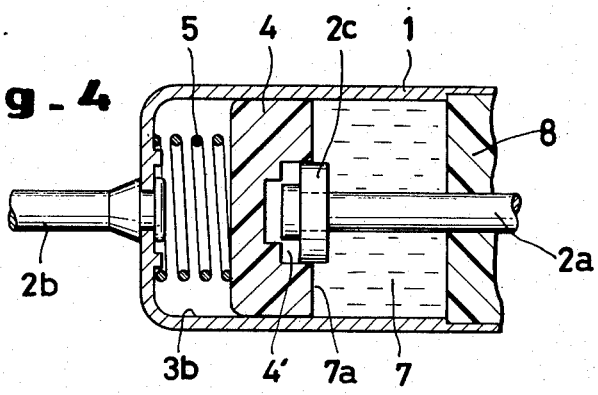
FIG. 4 is a longitudinally sectioned view of the second preferred embodiment of the thermal cut-off fuse according to the present invention, in the state assumed after the temperature of the ambience has reached the prescribed temperature.

When the contact means is made of a known material like electroconductive rubber which combines electric conductivity and resiliency, it can concurrently fulfill the role of a bushing. As the result, the bushing may be eliminated and the member 7 may be held in direct contact with the contact means 4 as illustrated in FIG. 4. In this case, the breakage of the electric continuity between the two lead wires 2a, 2b which occurs when the member 7 is melted and voluminally expanded can be more readily effected by allowing a portion 4' formed in the contact means 4 for the purpose of engagement with the terminal portion 3a and the flange 2c to be formed in a blind construction and forming a flange 2c of an insulating material to have a size capable of maintaining a sealed state between itself and the portion 4' of the contact means 4 even when the member 7 is in a molten state. Use of the spring means of high strength ensures safe re-establishment of the electric continuity.

Ample addition to the strength of the spring 5 has no adverse effects. This is because the energy of expansion produced by a substance contained in a tightly sealed space is quite large. The reliability of the establishment of electric continuity, therefore, can be ensured by amply increasing the strength with which the contact means and the terminal 3a are pressed against each other while the thermal cut-off fuse is in its normal state or the electric continuity is being reestablished.

Optionally, a resilient piece of rubbery substance may replace the coil spring in the hollow space of the housing on the side of the second position of the contact means. The resilient force exerted by this resilient piece acting as the spring means 5 may be utilized for the purpose of moving the contact means between the two positions. Incorporation of this spring means 5 is seen in the embodiment to be described afterward.

Figure 5:
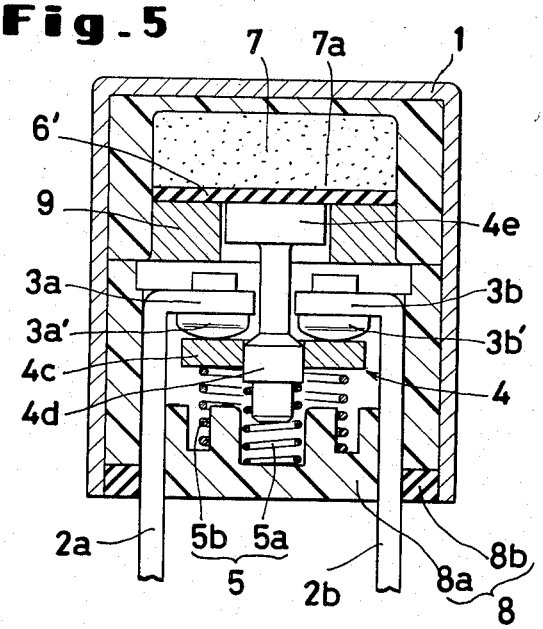
FIG. 5 is a longitudinally sectioned view of the third preferred embodiment of the thermal cut-off fuse according to the present invention, in the normal state.
Figure 6:
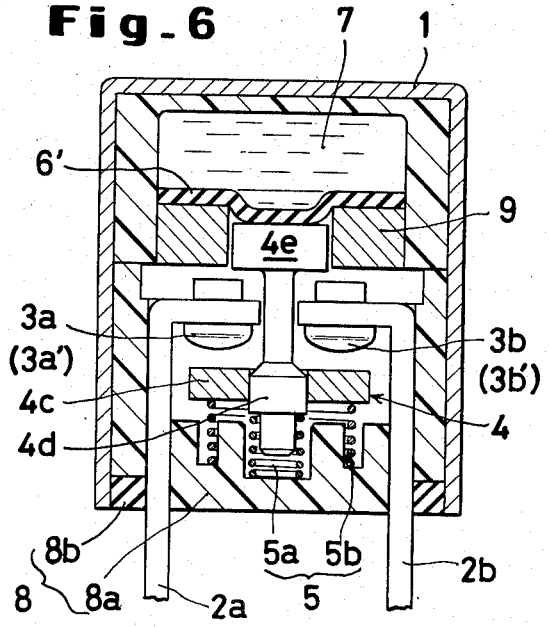
FIG. 6 is a longitudinally sectioned view of the thermal cut-off fuse of FIG. 5, in the state assumed after the temperature of the ambience has reached the prescribed temperature.

The embodiment illustrated in FIGS. 5 and 6 represents a thermal cut-off fuse of the vertical or radial type having two lead wires 2a, 2b extended in one and the same direction from the housing 1. In the present and following embodiments the component parts fulfilling the same functions as the corresponding parts in the first embodiment are denoted by the same numerical symbols.

The shape of the housing 1 may be freely chosen. For example, the housing may be in the shape of a cylinder or a rectangular column. The present embodiment will be described in terms of a cylindrical housing. Through one axial end of the housing 1, a pair of lead wires 2a, 2b extend in one and the same direction. The two lead wires are both inserted into the hollow space of the housing. Their leading ends are bent at right angles toward each other so that their tips are radially opposed to each other across a small gap. They are provided in the radially opposed portions with enlarged head portions 3a, 3b which are intended as lower-side contact faces.

The contact means 4 upwardly confronts these two head portions. This is the first position for the contact means. The contact means is at all times energized in the direction of the first position by the spring means 5. In this case, the spring means 5 is formed of the first coil spring means 5a upwardly pressing the peripheral portion 4c of the contact means and the second coil spring means 5b similarly pressing the central portion 4d of the contact means to ensure uniform distribution of the energizing force. It is naturally permissible to use just one coil spring means instead.

In the present embodiment, the contact means 4 itself is formed of two parts, i.e. the peripheral 4c and the central portion 4d. By having these two parts assembled through pressed insertion, the contact means is both integrated and solidified functionally. The central portion 4d is upwardly extended in the shape of a shaft through the gap between the two terminal portions 3a, 3b. Its upper end terminates in a head portion 4e of a slightly increased diameter.

The head portion 4e of the contact means 4 is abutted by a diaphragm 6' made of a resilient substance such as rubber and supported along the periphery thereof by a support 9 made of relatively rigid rubber. Behind the diaphragm 6', there is sealed in a temperature-sensitive member 7 of which the surface 7a opposed to the contact means is tightly closed with the aforementioned diaphragm 6'.

The lower surface of the housing is sealed with a sealer member 8 which is formed of the lid portion 8a serving to support the other end of the spring means 5 and the peripheral seal portion 8b.

When the thermal cut-off fuse of the construction described above has its temperature elevated to the prescribed temperature, the diaphragm 6' is exposed to the force of expansion of the member, so that the portion of the diaphragm held in contact with the head portion 4e of the contact means other than the support portion 9 is gradually distended downwardly.

Since the force of this expansion is fairly strong as described above, the contact means 4 is pushed downwardly in spite of the energizing force exerted by the spring means 5, with the result that the two terminals 3a, 3b are separated from each other and the electric continuity between the two lead wires 2a, 2b is eventually broken (FIG. 6).

When the temperature of the ambience falls eventually below the preset temperature, the pellet begins to solidify with loss of volume. The force generated by the spring means 5 moves the contact means 4 upwardly in conjunction with the diaphragm 6' which is in the process of returning to its original position by its own resiliency. Consequently, the contact means is returned to the first position indicated in FIG. 1 and the electric continuity between the two lead wires is completed.

The diaphragm 6' is allowed to expand only in its central portion for the reason that the solidification of the member gradually proceeds inwardly from the periphery thereof and, consequently, the central portion thereof is cooled last. This limited expandability of the diaphragm 6' is aimed at equalizing the speed of return of the diaphragm 6' with that of the contact means during the solidification of the pellet.

When the diaphragm possesses a very strong resilient force, it can be relied on to fulfil concurrently the function of the resilient spring 5. In this case, therefore, the spring means 5 may be completely eliminated and the head portion 4*e* of the contact means may be fastened to the central portion of the diaphragm 6' or the diaphragm 6' may be integrally molded with the cylindrically shaped central portion 4*e* of the contact means. When the resilient spring means 5 is used as originally intended as well as when the diaphragm takes its place as described above, the spring means 5 or the diaphragm 6' can be disposed on the pellet side opposite to the side illustrated in the diagram so as to press the contact means against the terminal portion as though it was pulled upwardly.

Further in the present embodiment, the peripheral portion 4*c* of the contact means 4 exposed to contact with the terminal portion may be made of the aforementioned electrically conductive rubber material instead of the ordinary metal material. Particularly in the case of the peripheral portion which is adapted to be pressed into union with the shaft portion 4*d*, the functional integration of these two parts can be attained with increased reliability by making the peripheral portion with the electrically conductive rubber and considerably decreasing the diameter of the hole formed for admitting the insertion of the shaft portion 4*d* so that the resilience of the material barely permits the forced insertion of the shaft portion through that hole. This arrangement also contributes to the convenience of the thermal cut-off fuse of this invention.

Figure 7:
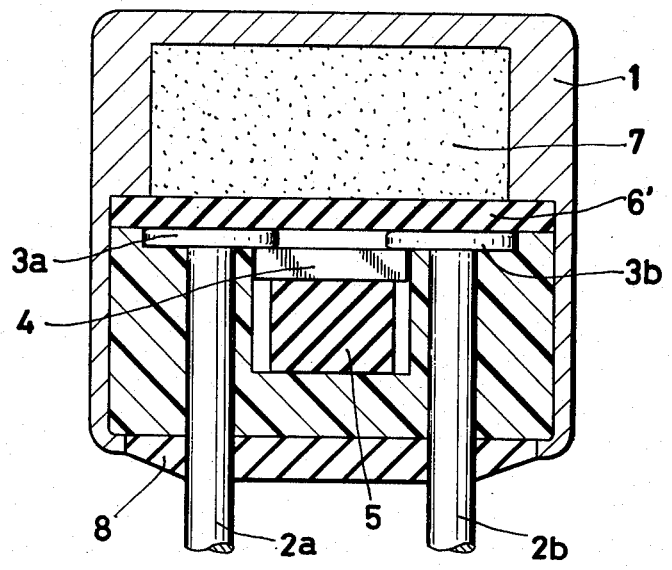
FIG. 7 is a longitudinally sectioned view of the fourth preferred embodiment of the thermal cut-off fuse according to the present invention, in the normal state.
Figure 8:
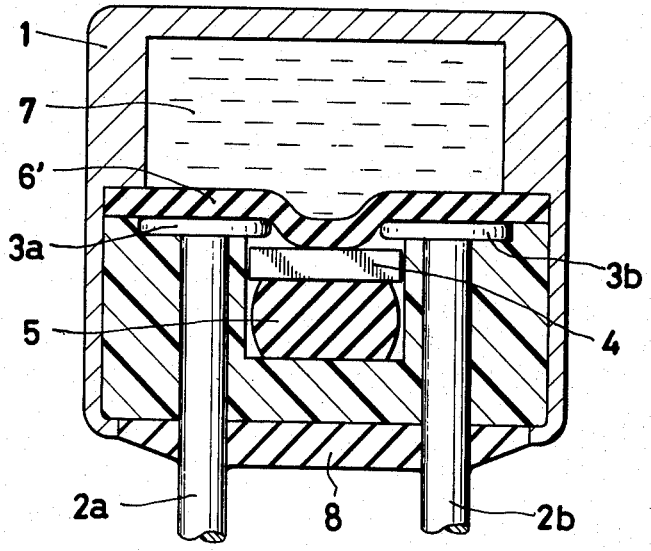
FIG. 8 is a longitudinally sectioned view of the thermal cut-off fuse of FIG. 7, in the state assumed after the temperature of the ambience has reached the prescribed temperature.

The embodiment illustrated in FIGS. 7 and 8 represents a modification given to the thermal cut-off fuse of the present invention by replacing the resilient spring means from a coil spring of metallic material to an elastic block of rubber.

The two terminals 3*a*, 3*b* each have the appearance of a flat head as though they were shaped by crushing the leading ends of the lead wires inside the housing. The undersides of the terminal portions 3*a*, 3*b* of an increased diameter are kept in contact with the contact means 4. This is the first position of the contact means 4. The resilient spring means 5 which serves to energize the contact means at all times against the aforementioned undersides of the terminal portions is formed of a block of resilient material such as rubber.

Another difference due to the modification is that the contact means has the shape of a simple, falt disc and, instead, the diaphragm 6' is disposed at a position low enough to come into contact with the remaining sides of the lead terminal portions 3*a*, 3*b* respectively. The two terminal portions, therefore, concurrently fulfill the part of the support portion 9 involved in the embodiment described above.

Because of this construction, when the member 7 tightly sealed by the diaphragm 6' inside the space on the side of the first position of the contact means within the hollow space of the housing melts and voluminally expands at the preset temperature, the diaphragm 6' is allowed to distend exclusively through the opening between the two flat-headed terminal portions 3*a*, 3*b*, come into contact with the contact means 4 and push the contact means downwardly and, by overcoming the resilient force of the resilient block 5 and deforming the resilient block downwardly, bring the contact means to its second position, namely the position separated from the two terminal portions 3*a*, 3*b* (FIG. 8).

When the temperature of the ambience begins to fall and the member consequently begins to solidify, the diaphragm 6' by its own resilient force regains its original shape as illustrated in FIG. 7. On the other hand, the contact means 4 is also caused by the resilient force of the resilient block 5 to return to its first position.

In the case of the present embodiment, the construction of the thermal cut-off fuse is particularly simple. In this construction, the number of component parts can further be decreased by having the contact means 4 made of an electrically conductive rubber material and integrally molded with the resilient block as the spring means. In this case, the resilient block illustrated in the drawing may be formed in an annular shape with the interior hollowed out.

In the case of the two embodiments illustrated in FIGS. 5 through 8, the housing 1 may be made of an electrically conductive material or electrically insulating material such as a resin. When an electrically conductive material is chosen, one of the lead wires may be directly attached caulkingly to the housing so that the inner wall of the housing will serve as the terminal portion of that lead wire and, between this terminal portion and the terminal of the other lead wire inserted into the hollow space of the housing, the contact means 4 will make and break the electric continuity, by utilizing the idea of the first embodiment.

In any of the embodiments described thus far, the lead wires 2*a*, 2*b* may be in any of the various shapes including those of circular wires. Optionally, the shell of the housing itself may be used as one of the lead wires.

As described in detail above, the present invention can provide self-restoring type thermal cut-off fuse of very easy fabrication. For the purpose of applications heretofore fulfilled by thermostats, these self-restoring type thermal cut-off fuses by far excel the thermostats in terms of space requirement, cost, reliability of performance and accuracy of operation.

What is claimed is:

1. A self-restoring type thermal cut-off fuse for making electric continuity between first and second lead wires extended out of a housing when the temperature of the ambience is lower than a prescribed temperature and breaking said electric continuity when said temperature rises above the prescribed temperature, which thermal cut-off fuse comprises an electrically conductive contact means adapted to move between first and second positions in a hollow space of said housing and, while at said first position, remain in contact with both first and second terminal portions electrically connected within said housing respectively to said first and second lead wires and, while at said second position, separate from at least one of said first and second terminal portions; a temperature-sensitive member tightly sealed in a space on the side of the first position of said contact means within the hollow space of said housing so as to abut one surface of said contact means, said temperature-sensitive member having the property of retaining a solid state under normal conditions and, at the prescribed temperature, melting with increase in volume and, on falling to a temperature lower than said prescribed temperature, solidifying with loss of volume; and resilient energizing means adapted to keep said contact means energized at all times in the direction from the second position to the first position and possessed of energizing force insufficient to overcome the force which said temperature-sensitive member generates upon melting with increase in volume in the direction of causing the surface of said temperature-sensitive member abutting said contact means to move said contact means to the second position and sufficient to energize said contact means to the first position at the time said temperature-sensitive member solidifies with loss of volume.

2. The thermal cut-off fuse according to claim 1, wherein the means for sealing tightly the surface of the temperature-sensitive member abutting the contact means and, at the same time, permitting the movement of said surface is an elastic bushing means disposed between said surface and the contact means and adapted to come into pressed contact with the inner wall of the housing.

3. The thermal cut-off fuse according to claim 1, wherein the means for sealing tightly the surface of the temperature-sensitive member abutting the contact means and, at the same time, permitting the movement of said surface is an elastic diaphragm means disposed between said surface and the contact means and having the peripheral portion thereof fastened in position.

4. The thermal cut-off fuse according to any of claims 1 through 3, wherein the resilient energizing means is a coil spring.

5. The thermal cut-off fuse according to any of claims 1 through 3, wherein the resilient energizing means is a rubbery elastomer.

* * * * *

UNITED STATES PATENT AND TRADEMARK OFFICE

CERTIFICATE OF CORRECTION

PATENT NO. : 4,281,307

DATED : July 28, 1981

INVENTOR(S) : Kunio Hara

It is certified that error appears in the above—identified patent and that said Letters Patent is hereby corrected as shown below:

On the title page, Item [30] should read:

--- Foreign Priority Data February 23, 1979 (JP) Japan 54-19632 ---.

Signed and Sealed this

*Sixth* Day of *October 1981*

[SEAL]

*Attest:*

GERALD J. MOSSINGHOFF

*Attesting Officer*

*Commissioner of Patents and Trademarks*